US005829758A

United States Patent [19]

Bott

[11] Patent Number: 5,829,758

[45] Date of Patent: Nov. 3, 1998

[54] IN-LINE ALL TERRAIN SKATE APPARATUS

[76] Inventor: Joel A. Bott, P. O. Box 356, Carpenteria, Calif. 93014

[21] Appl. No.: 868,634

[22] Filed: Jun. 2, 1997

Related U.S. Application Data

[63] Continuation of Ser. No. 508,095, Jul. 27, 1995, abandoned.

[51] Int. Cl.[6] ..... A63C 1/04

[52] U.S. Cl. ..... 280/11.32; 280/11.22

[58] Field of Search ..... 280/11.22, 11.2, 280/11.3, 11.31, 11.32, 623, 14.2

[56] References Cited

U.S. PATENT DOCUMENTS

| | | | |
|---|---|---|---|
| 530,711 | 12/1894 | Nicholls . | |
| 593,278 | 11/1897 | Moulton . | |
| 922,774 | 5/1909 | Kennedy . | |
| 1,428,210 | 9/1922 | Boche . | |
| 1,527,840 | 2/1925 | Chomin . | |
| 2,570,349 | 10/1951 | Kardhordo | 280/11.22 |
| 3,314,687 | 4/1967 | Tiesler | 280/11.35 |
| 3,880,441 | 4/1975 | Silver | 280/11.22 |
| 3,936,063 | 2/1976 | Sittmann | 280/11.35 P |
| 4,298,209 | 11/1981 | Peters | 280/11.2 |
| 4,353,575 | 10/1982 | Brice | 280/614 |
| 4,909,523 | 3/1990 | Olson | 280/11.2 |
| 5,046,746 | 9/1991 | Gierveld | 280/11.22 |
| 5,401,041 | 3/1995 | Jespersen | 280/14.2 |

FOREIGN PATENT DOCUMENTS

| | | |
|---|---|---|
| 2589361 | 5/1987 | France . |
| 1817271 | 7/1970 | Germany . |
| 602147 | 1/1978 | Switzerland . |
| 2078530 | 1/1982 | United Kingdom . |

OTHER PUBLICATIONS

Field–Proven Gear, "Karhu 10th Mountain Skis and Sets", 1 pg.

"WORTH THE WAIT", Cross–Country Skier, Feb./Mar. 1992, pp. 34 and 35.

*Primary Examiner*—Brian L. Johnson
*Assistant Examiner*—Avraham Lerner
*Attorney, Agent, or Firm*—Stetina Brunda Garred & Brucker

[57] ABSTRACT

An in-line, all terrain skate apparatus for retrofit to a conventional ski boot. The skate apparatus generally comprises a frame member having front and back ends and defining a longitudinal axis extending between the front and back ends. Rotatably connected to the frame member are a plurality of wheels which are disposed in horizontal, linear alignment. Rigidly connected to the front end of the frame member is a toe connector which is sized and configured to receive a toe portion of the ski boot and rigidly secure the toe portion to the frame member when the toe portion is inserted thereinto. Pivotally connected to the rear end of the frame member is a heel connector which is sized and configured to be engageable to a heel portion of the ski boot and releasably secure the heel portion to the frame member when engaged thereto. The heel connector is adapted to be pivotally secured to any one of a number of pairs of corresponding apertures so as to allow the heel connector to be selectively positioned along the longitudinal axis of the frame member.

6 Claims, 2 Drawing Sheets

IN-LINE ALL TERRAIN SKATE APPARATUS

This application is a continuation of application Ser. No. 08/508,095, filed Aug. 27, 1995 and now abandoned.

FIELD OF THE INVENTION

The present invention relates generally to recreational equipment, and more particularly to in-line, all terrain skate apparatus which is retrofittable to a conventional ski boot to allow a user to skate along surfaces including grass, concrete, dirt and the like.

BACKGROUND OF THE INVENTION

A popular recreational activity in many areas of the United States is snow skiing. In downhill skiing, one of the few required pieces of equipment other than the snow skis are the ski boots. Typically, the ski boots are formed from a semi-rigid plastic material and are configured having a flat sole and toe and heel portions which project outwardly from the front and rear ends of the ski boot to define planar surfaces for engagement to the ski bindings of the skis. Due to the configuration of the ski boots, the boots possess little or no utility when not being utilized in conjunction with the skis. As such, during the summer months the skis and hence the ski boots are generally not used.

Another recreational activity which has recently begun increasing in popularity is the use of skate devices commonly referred to as blade skates. Blade skates are devices which resemble conventional ice skates but include a plurality of in-line, small diameter wheels as an alternative to the blade portion of the ice skate. The use of blade skates is particularly popular during the summer months since such skates are not adapted to be used in adverse weather conditions such as snow or sleet. Additionally, the blade skates, due to the diameter of the wheels used therewith, are not adapted to be utilized on rough terrain such as grass or dirt. Further, due to the small wheel diameters of the skates, obstructions on concrete or asphalt surfaces such as gravel or mud will often cause the skater to fall when such obstructions are encountered.

The present invention provides advantages over conventionally known blade skates by providing an in-line, all terrain skate apparatus which is adapted to be utilized on surfaces such as concrete, asphalt, grass and dirt. Additionally, the diameter of the wheels used in conjunction with the present skate apparatus are such that obstructions in grass or dirt surfaces such as roots or sticks, and on concrete or asphalt surfaces such as mud and gravel, will not interfere with the use of the apparatus. Further, the present skate apparatus is specifically adapted to be retrofittable to a conventional ski boot. As such, since "bladeskating" is primarily a summer activity, the ski boots of the user which would not otherwise be used during the summer months may be used in conjunction with the skate apparatus. Since the present skate apparatus makes use of the ski boots rather than incorporating separate boot portions, the cost associated therewith is significantly less than that associated with currently manufactured blade skates.

SUMMARY OF THE INVENTION

In accordance with a preferred embodiment of the present invention, there is provided an in-line, all terrain skate apparatus for use on a conventional ski boot. The skate apparatus generally comprises an elongate frame member having a front end and a back end, and defining a longitudinal axis extending between the front and back ends. In the preferred embodiment, the frame member has a generally U-shaped configuration defining a top wall and first and second opposing side walls extending perpendicularly downward from the top wall. Rotatably connected to the frame member between the opposed side walls are plural, preferably three, wheels which are in horizontal, linear alignment and are preferably spaced equidistantly along the longitudinal axis of the frame member. Each of the wheels is preferably attached to the frame member via an axle member which extends therethrough and which includes opposed ends attached to the first and second side walls of the frame member. The frame member is preferably fabricated from aluminum and includes a plurality of openings disposed therein for decreasing the weight thereof.

Rigidly connected to the front end of the frame member is a toe connector which is sized and configured to receive a toe portion of the ski boot and rigidly secure the toe portion to the frame member when the toe portion is inserted thereinto. Rigidly connected to the rear end of the frame member is a heel connector which is sized and configured to be engageable to a heel portion of the ski boot and releasably secure the heel portion to the frame member when engaged thereto. In the preferred embodiment, the heel connector comprises a first rod member pivotally connected to the first side wall adjacent the back end of the frame member and a second rod member pivotally connected to the second side wall adjacent the back end of the frame member. The first and second rod members preferably have proximal ends pivotally connected to a respective side wall and threaded distal ends. Slidably attached to and extending between the first and second rod members is a cross piece which is selectively positionable along the length of the rod members and engageable to the heel portion of the ski boot. Threadably engaged to the distal end of the first rod member is a first handle member, while threadably engaged to the distal end of the second rod member is a second handle member. The first and second handle members are used in combination to maintain the cross piece in rigid engagement with the heel portion of the ski boot.

In the preferred embodiment, the heel connector is selectively positionable along the rear portion of the longitudinal axis of the frame member to accommodate different size ski boots. To facilitate such positioning, disposed in the first side wall of the frame member adjacent the back end thereof is a first set of horizontally oriented, linearly aligned apertures, each of which are sized to pivotally receive the proximal end of the first rod member. Additionally, disposed in the second side wall adjacent the back end of the frame member is a second set of horizontally oriented, linearly aligned apertures, each of which are sized to pivotally receive the proximal end of the second rod member and which are coaxially aligned with a corresponding aperture of the first set. As such, by selectively placing the proximal ends of the first and second rod members into a corresponding pair of the first and second sets of apertures, the heel connector may be selectively positioned along the rear portion of the longitudinal axis of the frame member.

In the preferred embodiment, the skate apparatus of the present invention is retrofitted to a conventional ski boot by first abutting the sole of the ski boot against the frame member of the ski apparatus. The ski boot is then slid forward on the frame member so as to insert the toe portion of the ski boot into the toe connector rigidly secured to the front end of the frame member. Thereafter, the heel connector attached to the frame member is brought into abutting contact with the heel portion of the ski boot. The heel connector is then locked into engagement with the heel portion via the utilization of the first and second handle members. The retrofit of the present skate apparatus to the ski boot may further include the step of selectively positioning the heel connector along the longitudinal axis of the frame member in the manner previously described.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
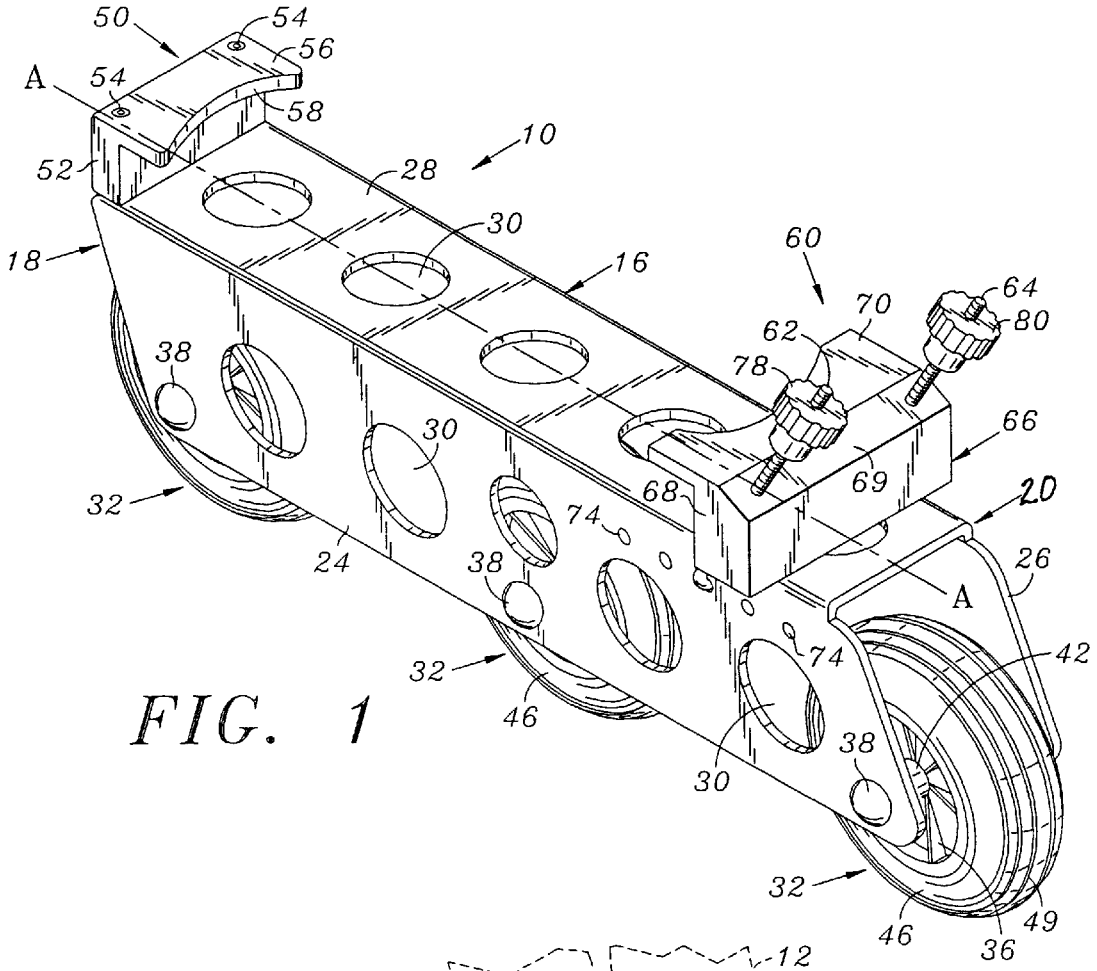
FIG. 1 is a perspective view of the skate apparatus of the present invention.
Figure 4:
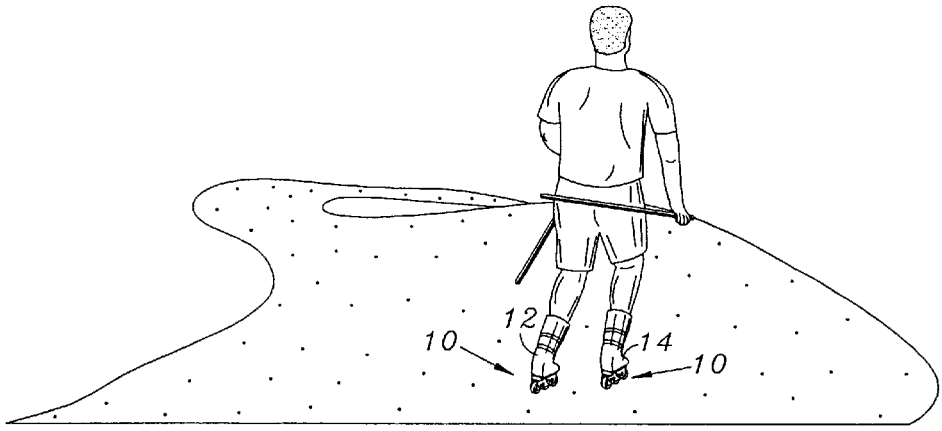
FIG. 4 is a perspective view illustrating the use of the present invention.

Referring now to the drawings wherein the showings are for purposes of illustrating a preferred embodiment of the present invention only, and not for purposes of limiting the same, FIG. 1 illustrates a skate apparatus 10 constructed in accordance with the preferred embodiment of the present invention. As seen in FIG. 4, two (2) separate units of the skate apparatus 10 will typically be needed by the skater, with each skate apparatus 10 being engaged to a respective one of the ski boots 12, 14 of the ski boot pair. In the preferred embodiment, the skate apparatus 10 used in conjunction with the left ski boot 12 and the skate apparatus 10 used in conjunction with the right ski boot 14 are identically configured. As such, though the skate apparatus 10 will hereinafter be described as being used in conjunction with the left ski boot 12, it will be recognized that the skate apparatus 10 may be used with either of the ski boots 12, 14 of the ski boot pair.

In the preferred embodiment, skate apparatus 10 generally comprises an elongate frame member 16 having a front end 18 and a back end 20. The frame member 16 preferably has a generally U-shaped configuration defining a top wall 22 and first and second opposing side walls 24, 26 extending perpendicularly downward from the top wall 22. Extending longitudinally along the top surface 28 of top wall 22 between the front end 18 and back end 20 of the frame member 16 is an axis A. In the preferred embodiment, frame member 16 is fabricated from aluminum, though other materials may be utilized as an alternative. Additionally, the top wall 22, first side wall 24 and second side wall 26 are preferably provided with a plurality of openings 30 which are used to decrease the weight of the frame member 16.

Figure 3:
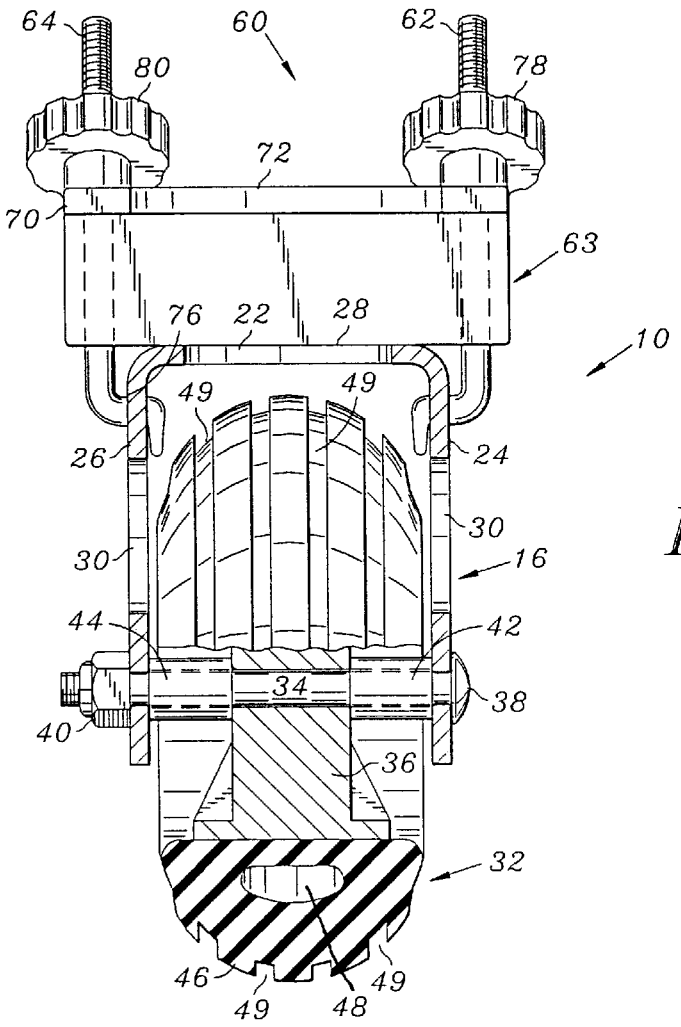
FIG. 3 is a cross-sectional view taken along line 3—3 of FIG. 2.

Rotatably connected to the frame member 16 are a plurality of wheels 32 which are connected between the first and second side walls 24, 26 of the frame member 16 in horizontal, linear alignment. The frame member 16 preferably includes three (3) wheels 32 rotatably connected thereto, though it will be recognized that different numbers of wheels 32 may be utilized. Referring now to FIG. 3, each of the wheels 32 are preferably attached to the frame member 16 via an axle member 34 which extends through the hub 36 of the wheel 32. In attaching a wheel 32 to the frame member 16, the axle member 34 is initially inserted through an aperture disposed in the lower portion of the first side wall 24, extended through the hub 36, and subsequently inserted through a corresponding aperture disposed in the lower portion of the second side wall 26 which is in coaxial alignment with the aperture disposed in the first side wall 24. When fully inserted into the coaxially aligned apertures and through the hub 36, the head portion 38 of the axle member 34 is abutted against the outer surface of the first side wall 24. To maintain the axle member 34 in engagement with the frame member 16, threadably engaged to the threaded distal end of the axle member 34 which protrudes outwardly from the second side wall 26 is a lock nut 40. To aid in the rotation of the wheel 32, and more particularly the hub 36, disposed about the axle member 34 between the hub 36 and first side wall 24 is a first tubular bearing 42, while disposed about the axle member 34 between the hub 36 and second side wall 26 is a second tubular bearing 44.

Disposed about the outer surface of the hub 36 is a wheel cover 46 which includes an open space 48 formed therein to provide the wheel cover 46 and hence the wheel 32 with shock absorbing capability. In the preferred embodiment, each wheel cover 46 is formed from rubber having a diameter and width substantially exceeding the diameter and width of the wheels of currently manufactured blade skates. Particularly, the outer diameter of each wheel cover 46 ranges from 3–5 inches and is preferably 4 inches, while the width of each wheel cover 46 ranges from 1–3 inches and is preferably 2 inches. Additionally, disposed about the outer surface of each of the wheel covers 46 are a plurality of annular treads 49.

Figure 2:
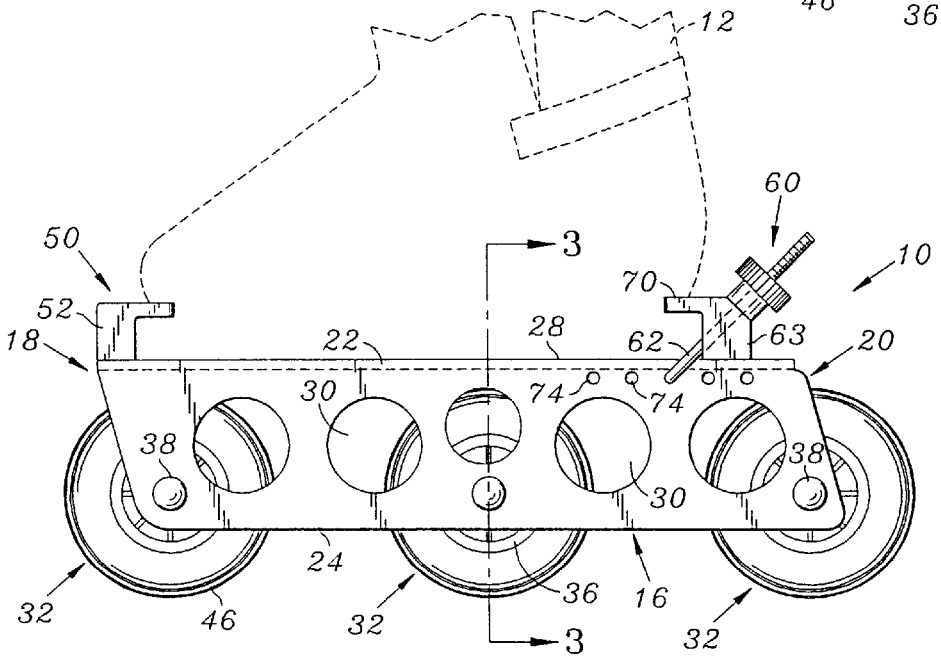
FIG. 2 is a side elevational view of the present invention illustrating a conventional ski boot engaged thereto.

As best seen in FIGS. 1 and 2, in the preferred embodiment the three (3) wheels 32 attached to the frame member 16 are equidistantly spaced along the longitudinal axis A. A first wheel 32 is preferably attached to the frame member 16 adjacent to and protruding outwardly from the front end 18 thereof, with a second wheel 32 being attached to the frame member 16 adjacent to and protruding outwardly from the back end 20. The third wheel 32 is preferably attached to the frame member 16 in approximately the center thereof. Advantageously, by constructing the wheels 32 from the aforementioned components, and orienting the wheels 32 on the frame member 16 in the aforementioned manner, the skate apparatus 10 is adapted to be usable on a variety of terrains including grass, dirt, concrete, and asphalt. In this respect, the orientation of the wheels 32 and the length and width of the wheel covers 46 allows the skate apparatus 10 to pass over these terrains as well as obstructions such as roots and sticks which may be encountered on dirt or grass surfaces and mud or gravel which may be encountered on concrete or asphalt surfaces. Additionally, the inclusion of the treads 49 within the wheel covers 46 provides the traction needed to allow the skate apparatus 10 to pass over rough terrains.

Referring now to FIGS. 1 and 2, rigidly connected to the front end 18 of the frame member 16 is a toe connector 50. Toe connector 50 generally comprises a base portion 52 which is rigidly connected to top surface 28 of the top wall 22 adjacent the front end 18 via a pair of fasteners 54 such as screws or rivets. Extending horizontally inward from the base portion 52 along the axis A is a toe engaging portion 56 which defines an arcuate inner surface 58. As seen in FIG. 2, when the ski boot 12 is interfaced to the skate apparatus 10, the toe portion of the ski boot 12 is slid underneath the toe engaging portion 56 of the toe connector 50, with such insertion being limited by the abutment of a front arcuate toe portion of the ski boot 12 against the arcuate inner surface 58. When the ski boot 12 is slid into this position, it is prevented from lifting off of the frame member 16 by the abutment of the bottom surface of the toe engaging portion 56 against a top planar surface defined by the toe portion of the ski boot 12.

Pivotally connected to the back end 20 of the frame member 16 is a heel connector 60. Heel connector 60 generally comprises a first rod member 62 pivotally connected to the first side wall 24 adjacent the back end 20 of the frame member 16, and a second rod member 64 pivotally connected to the second side wall 26 adjacent the back end 20 of the frame member 16. Slidably attached to and extending between the first rod member 62 and second rod member 64 is a cross piece 66. The cross piece 66 includes a base portion 68 defining an angled surface 69 and having a pair of apertures extending angularly therethrough into which are inserted the first and second rod members 62, 64. The cross piece 66 further includes a heel engaging portion 70 extending horizontally inward from the base portion 68 along the axis A. Similar to the toe engaging portion 56 of the toe connector 50, the heel engaging portion 70 of the cross piece 66 defines an arcuate surface 72 along the inner edge thereof.

Prior to the receipt of the first and second rod members 62, 64 into the apertures disposed within the base portion 68 of the cross piece 66, each of the rod members 62, 64 are pivotally connected to a respective side wall of the frame member 16. As seen in FIGS. 1 and 2, disposed in the first side wall 24 adjacent the back end 20 of the frame member 16 is a first set of horizontally oriented, linear aligned apertures 74. Similarly, disposed in the second side wall 26 adjacent the back end 20 of the frame member 16 is a second set of horizontally oriented, linearly aligned apertures 76, each of which are coaxially aligned with a corresponding aperture 74 of the first set. Each of the apertures 74 of the first set is sized and configured to pivotally receive the proximal end of the first rod member 62, while each of the apertures 76 of the second set is sized and configured to pivotally receive the proximal end of the second rod member 64. As best seen in FIG. 3, the proximal ends of the first and second rod members 62, 64 have bent configurations so as to be pivotally engageable to and maintainable within a corresponding pair of the apertures 74, 76. The use of the first and second sets of apertures 74, 76 will be explained below.

After the rod members 62, 64 have been pivotally received into a corresponding pair of the apertures 74, 76, the distal ends of the first and second rod members 62, 64 are inserted through the pair of angled apertures disposed within the base portion 68 of the cross piece 66. As will be recognized, when the rod members 62, 64 are inserted into the apertures, the cross piece 66 is oriented such that the heel engaging portion 70 faces inwardly toward the toe connector 50. The cross piece 66 is oriented in this manner so that the heel engaging portion 70 thereof may be abutted against a top planar surface of the heel portion of the ski boot 12. The engagement of the heel engaging portion 70 to the heel portion of the ski boot 12 is limited by the abutment of the arcuate surface 72 against the arcuate heel portion of the ski boot 12. In the preferred embodiment, the cross piece 66 is cooperatively engaged to the heel portion of the ski boot 12 by sliding the same downwardly along the first and second rod members 62, 64 until the heel engaging portion 70 abuts the top planar surface of the heel portion.

To accommodate the particular size of the ski boot 12, small adjustments may be made to the position of the cross piece 66 by pivoting the rod members 62, 64 toward or away from the ski boot 12 and either lowering or raising the cross piece 66 along the rod members 62, 64 so as to properly abut the heel engaging portion 70 against the heel portion of the ski boot 12 and the arcuate surface 72 against the arcuate heel portion. In those instances when the pivotal motion of the rod members 62, 64 and movement of the cross piece 66 are not sufficient to accommodate the size of the ski boot 12, the cross piece 66 may be removed from the rod members 62, 64 with the rod members 62, 64 being removed from the pair of apertures 74, 76 into which they are received, and subsequently pivotally received into a different pair of corresponding apertures 74, 76. As such, the first set of apertures 74 and second set of apertures 76 allows for large adjustments to the longitudinal positioning of the cross piece 66 along the axis A, while the pivotal motion of the first and second rod members 62, 64 within a corresponding pair of apertures 74, 76 allows for minor adjustments to the positioning of the cross piece 66 along the axis A. After the first and second rod members 62, 64 are placed in a desired pair of corresponding apertures 74, 76, the rod members 62, 64 are reinserted into the cross piece 66 in the previously described manner.

Once the cross piece 66, and more particularly the heel engaging portion 70 thereof, has been properly abutted against the heel portion of the ski boot 12, the cross piece 66 is maintained in such engagement via a first handle member 78 threadably engaged to the threaded distal end of the first rod member 62, and a second handle member 80 threadably engaged to the threaded distal end of the second rod member 64. In this respect, by turning the first and second handle members 78, 80 in a clockwise direction, the handle members 78, 80 are caused to move downwardly along the threaded portions of the first and second rod members 62, 64 and come into abutting contact with the angled surface 69, thus locking the cross piece 66 against the heel portion of the ski boot 12 in the manner shown in FIG. 2.

In retrofitting the skate apparatus 10 to the ski boot 12, initially the sole of the ski boot 12 is abutted against the top surface 28 of the top wall 22. Thereafter, the toe portion of the ski boot 12 is slid along the axis A toward the front end 18 of the ski boot 12 so as to be inserted into the toe connector 50 rigidly secured to the frame member 16 in the manner previously described. In this respect, the toe portion is fully inserted into the toe connector 50 when the arcuate inner surface 58 of the toe engaging portion 56 is abutted against the arcuate toe portion of the ski boot 12. The heel engaging portion 70 of the cross piece 66 is then brought into abutting contact with the heel portion of the ski boot 12 by pivoting the first and second rod members 62, 64 within the corresponding pair of apertures 74, 76 and selectively positioning the cross piece 66 along the length of the rod members 62, 64. As will be recognized, prior to the engagement of the cross piece 66 to the heel portion, the first and second rod members 62, 64 are disposed in a corresponding pair of apertures 74, 76 which will accommodate the particular size of the ski boot 12. The heel engaging portion 70 of the cross piece 66 is abutted against the heel portion of the ski boot 12, with the arcuate surface 72 being abutted against the arcuate heel portion thereof. Thereafter, the first and second handle members 78, 80 are brought into engagement with the angled surface 69 of the base portion 68 thus locking the cross piece 66 against the heel portion.

Additional modifications and improvements of the present invention may also be apparent to those skilled in the art. Thus, the particular combination of parts described and illustrated here and is intended to represent only one embodiment of the invention, and is not intended to serve as limitations of alternative devices within the spirit and scope of the invention.

What is claimed is:

1. An in-line skate apparatus for use on a ski boot, the ski boot having heel and toe portions configured to attach to ski bindings, the skate comprising:

an elongate frame member having a front end and a back end and defining a longitudinal axis extending between said front and back ends;

a plurality of wheels rotatably connected to said frame member in horizontal, linear arrangement;

a toe connector rigidly connected to the front end of said frame member, said toe connector being sized and configured to receive the toe portion of the ski boot and rigidly secure the toe portion to said frame member when the toe portion is inserted thereinto; and a heel connector pivotally connected to the back end of said frame member, said heel connector being sized and configured to be lockably engageable to the heel portion of the ski boot and operable to secure the heel portion to the frame member, said heel connector being locked to the heel portion when engaged thereto, said heel connector comprising:

a first rod member having a threaded distal end and a proximal end pivotally connected to a first side wall adjacent the back end of said frame member;

a second rod member having a threaded distal end and a proximal end pivotally connected to a second side wall adjacent the back end of said frame member;

a cross piece slidably attached to and extending between said first and second rod members, said cross piece being situated entirely below the distal ends of the rod members and selectively positionable along the length of said rod members and engageable to the heel portion of the ski boot; and means attached to said rod members for maintaining said cross piece in rigid engagement with the heel portion, said means comprising a first handle member threadably engaged to the distal end of said first rod member and a second handle member threadably engaged to the distal end of said second rod member.

2. The apparatus as recited in claim 1 wherein said frame member further includes means for selectively positioning said heel connector along the longitudinal axis of the frame member to accommodate different size ski boots.

3. The device of claim 2 wherein said positioning means comprises:

a first set of horizontally oriented, linearly aligned apertures disposed in said first side wall adjacent the back end of the frame member, each of the apertures of the first set being sized to pivotally receive the proximal end of said first rod member; and a second set of horizontally oriented, linearly aligned apertures disposed in said second side wall adjacent the back end of the frame member, each of the apertures of the second set being sized to pivotally receive the proximal end of said second rod member and being coaxially aligned with a corresponding aperture of said first set.

4. An in-line skate apparatus for use on a ski boot, the ski boot having heel and toe portions configured to attach to ski bindings, the skate comprising:

an elongate frame member having a front end and a back end and defining a longitudinal axis extending between said front and back ends;

a plurality of wheels rotatably connected to said frame member in horizontal, linear arrangement;

a toe connector rigidly connected to the front end of said frame member, said toe connector being sized and configured to receive the toe portion of the ski boot and rigidly secure the toe portion to said frame member when the toe portion is inserted thereinto;

a heel connector pivotally connected to the back end of said frame member, said heel connector being sized and configured to be engageable to the heel portion of the ski boot and lockably secure the heel portion to the frame member when engaged thereto; and wherein said heel connector comprises:

a first rod member having a threaded distal end and a proximal end pivotally connected to a first side wall adjacent the back end of said frame member;

a second rod member having a threaded distal end and a proximal end pivotally connected to a second side wall adjacent the back end of said frame member;

a cross piece slidably attached to and extending between said first and second rod members, said cross piece being situated entirely below the distal ends of the rod members and selectively positionable along the length of said rod members and engageable to the heel portion of the ski boot; and means attached to said rod members for maintaining said cross piece in rigid engagement with the heel portion, said means comprising a first handle member threadably engaged to the distal end of said first rod member and a second handle member threadably engaged to the distal end of said second rod member.

5. The apparatus as recited in claim 4 wherein said frame member further includes means for selectively positioning said heel connector along the longitudinal axis of the frame member to accommodate different size ski boots.

6. The apparatus as recited in claim 5 wherein said positioning means comprises:

a first set of horizontally oriented, linearly aligned apertures disposed in said first side wall adjacent the back end of the frame member, each of the apertures of the first set being sized to pivotally receive a proximal end of said first rod member; and a second set of horizontally oriented, linearly aligned apertures disposed in said second side wall adjacent the back end of the frame member, each of the apertures of the second set being sized to pivotally receive a proximal end of said second rod member and being coaxially aligned with a corresponding aperture of said first set.

* * * * *